US010077060B2

(12) United States Patent
Tonguz

(10) Patent No.: US 10,077,060 B2
(45) Date of Patent: Sep. 18, 2018

(54) RAILROAD INTERLOCKING SYSTEM WITH DISTRIBUTED CONTROL

(71) Applicant: CARNEGIE MELLON UNIVERSITY, Pittsburgh, PA (US)

(72) Inventor: Ozan K. Tonguz, Pittsburgh, PA (US)

(73) Assignee: Carnegie Mellon University, Pittsburgh, PA (US)

( * ) Notice: Subject to any disclaimer, the term of this patent is extended or adjusted under 35 U.S.C. 154(b) by 42 days.

(21) Appl. No.: 14/413,839

(22) PCT Filed: Jul. 11, 2013

(86) PCT No.: PCT/US2013/050084

§ 371 (c)(1),
(2) Date: Jan. 9, 2015

(87) PCT Pub. No.: WO2014/011887

PCT Pub. Date: Jan. 16, 2014

(65) Prior Publication Data

US 2015/0142225 A1 May 21, 2015

Related U.S. Application Data

(60) Provisional application No. 61/741,047, filed on Jul. 11, 2012.

(51) Int. Cl.
*B61L 15/00* (2006.01)
*B61L 19/06* (2006.01)
(Continued)

(52) U.S. Cl.
CPC ..... *B61L 15/0018* (2013.01); *B61L 11/08* (2013.01); *B61L 15/0027* (2013.01);
(Continued)

(58) Field of Classification Search
None
See application file for complete search history.

(56) References Cited

U.S. PATENT DOCUMENTS 5,301,906 A * 4/1994 Bodnar, II ..... B61L 21/00 246/134
5,623,413 A * 4/1997 Matheson ..... B61L 27/0016 104/307
(Continued)

FOREIGN PATENT DOCUMENTS

CN 101254791 * 3/2008 ..... B61L 23/00
EP 2210791 7/2010
(Continued)

OTHER PUBLICATIONS

English Translation of CN101254791 (Year: 2008).*
International Search Report and Written Opinion dated Nov. 11, 2013 for Int'l. Appln. No. PCTUS2013050084 (10 pgs.).

*Primary Examiner* — Nicholas K Wiltey
(74) *Attorney, Agent, or Firm* — Fish & Richardson P.C.

(57) ABSTRACT

A system includes a transceiver for receiving one or more communications from a communication device in a railway vehicle; a microcontroller that is configured for communication with the transceiver and that is configured to control a position of a switch in the railway; and an electronic subsystem for interfacing with the microcontroller and with the switch; wherein the transceiver is configured to transmit to the microcontroller at least one of the one or more communications received from the railway vehicle; wherein the microcontroller is further configured to extract a command from the parsed contents; wherein the microcontroller is further configured to transmit the command to the electronic subsystem to cause the electronic subsystem to transition the switch to a position specified by the command; and
(Continued)

wherein transitioning of the switch to the specified position enables the railway vehicle to cross the switch.

23 Claims, 8 Drawing Sheets

(51) Int. Cl.
*B61L 11/08* (2006.01)
*B61L 27/00* (2006.01)

(52) U.S. Cl.
CPC ..... *B61L 15/0072* (2013.01); *B61L 19/06* (2013.01); *B61L 2027/005* (2013.01); *B61L 2205/02* (2013.01)

(56) References Cited

U.S. PATENT DOCUMENTS 7,549,610 B1 * 6/2009 Ireland ..... A63H 19/24 246/1 C
7,835,712 B1 * 11/2010 Shi ..... H04W 48/16 455/161.1
8,538,608 B2 * 9/2013 Meltser ..... B61C 17/12 246/187 C
9,195,402 B1 * 11/2015 Hostetter ..... G06F 3/061
2004/0193336 A1 * 9/2004 Sugita ..... B61L 23/14 701/19
2004/0267415 A1 * 12/2004 Lacote ..... B61L 23/34 701/19
2005/0209777 A1 9/2005 Peltz
2006/0195236 A1 * 8/2006 Katsuta ..... B61L 11/08 701/19
2007/0162199 A1 * 7/2007 Katsuta ..... B61L 27/0038 701/19
2007/0192668 A1 * 8/2007 Hrebek ..... B61L 3/127 714/781
2007/0225019 A1 * 9/2007 Knox ..... H04L 45/56 455/461
2012/0315894 A1 * 12/2012 Dussmann ..... H04B 7/15528 455/424
2013/0146719 A1 * 6/2013 Yoon ..... B61L 27/0005 246/122 R
2014/0103166 A1 * 4/2014 Asuka ..... B61L 23/24 246/4
2014/0209758 A1 * 7/2014 Kurita ..... B60L 15/40 246/2 S
2014/0232191 A1 * 8/2014 Doelling ..... B60M 3/04 307/42
2014/0323139 A1 * 10/2014 Lee ..... H04W 16/06 455/447
2014/0358338 A1 * 12/2014 Harasaki ..... H01L 21/67715 701/19
2015/0065146 A1 * 3/2015 Wenger ..... H04W 36/32 455/440
2015/0066962 A1 * 3/2015 Cortes ..... G06F 17/3056 707/755
2015/0142225 A1 * 5/2015 Tonguz ..... B61L 19/06 701/19
2015/0193030 A1 * 7/2015 Grover ..... B60K 37/06 701/36
2015/0225003 A1 * 8/2015 Morton ..... B61L 3/121 701/19
2015/0239481 A1 * 8/2015 Dymek ..... B61L 15/0027 701/19
2016/0016598 A1 * 1/2016 Li ..... B61L 15/0018 246/28 R

FOREIGN PATENT DOCUMENTS

WO WO004012019 2/2004
WO WO009061509 5/2009
WO WO014011887 1/2014

* cited by examiner

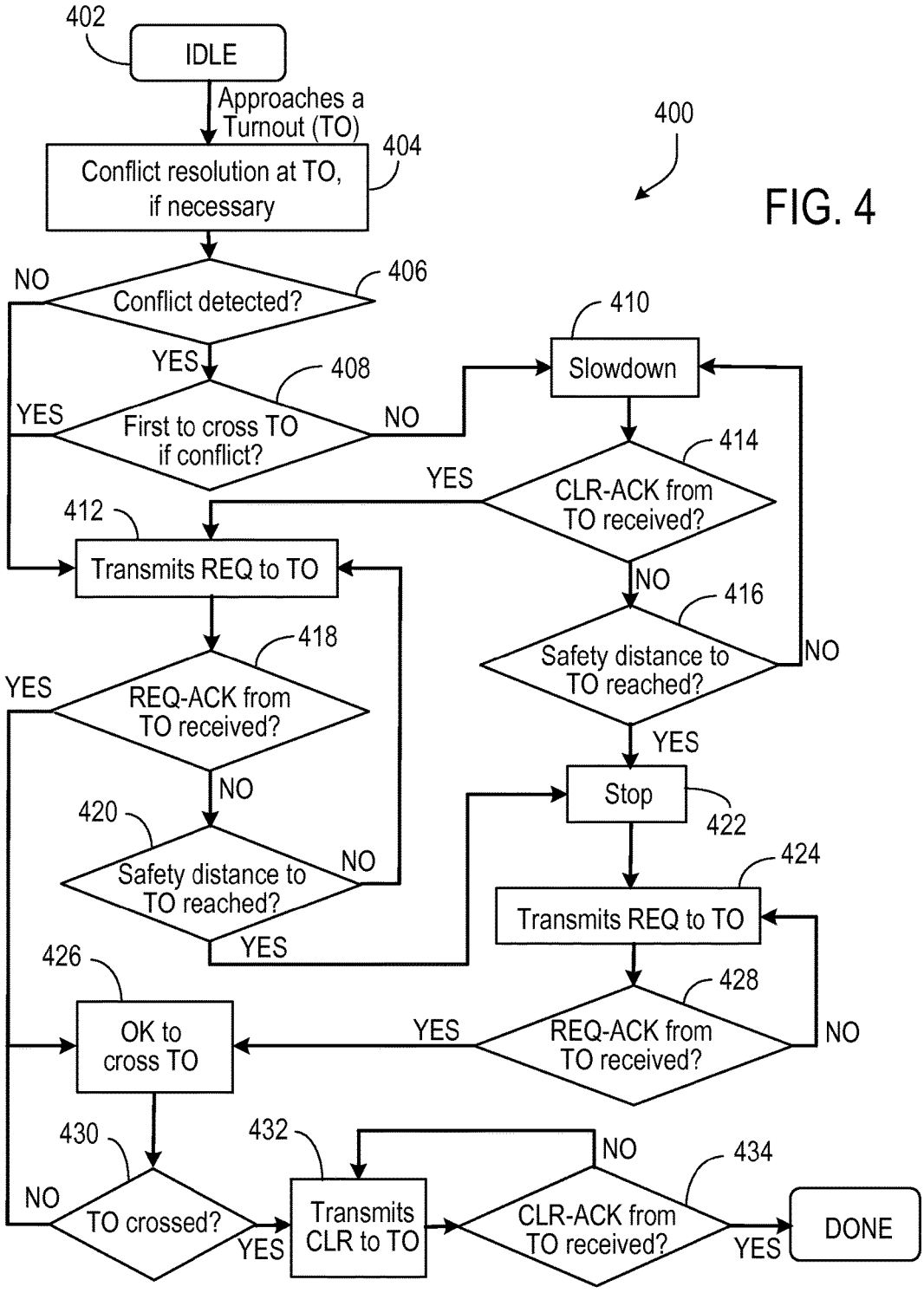
402
IDLE
Approaches a Turnout (TO)
404
Conflict resolution at TO, if necessary
400
FIG. 4
406
Conflict detected?
NO
YES
408
First to cross TO if conflict?
YES
NO
410
Slowdown
414
CLR-ACK from TO received?
YES
NO
412
Transmits REQ to TO
416
Safety distance to TO reached?
NO
YES
418
REQ-ACK from TO received?
YES
NO
420
Safety distance to TO reached?
NO
YES
Stop
422
424
Transmits REQ to TO
426
OK to cross TO
428
REQ-ACK from TO received?
YES
NO
430
TO crossed?
NO
YES
432
Transmits CLR to TO
NO
434
CLR-ACK from TO received?
YES
DONE

RAILROAD INTERLOCKING SYSTEM WITH DISTRIBUTED CONTROL

CLAIM OF PRIORITY

This application claims priority under 35 U.S.C. § 119(e) to provisional U.S. Patent Application 61/741,047, filed on Jul. 11, 2012, the entire contents of which are hereby incorporated by reference.

BACKGROUND

Rail transport is a very energy efficient means of freight and passenger transport. Compared to road transport using trucks, it consumes two to five times less energy. Train traffic is carefully and precisely planned by transportation engineers well in advance. There is an exact schedule for every train. However, this system is highly sensitive to any delays. To still allow for safe travel despite small changes or delays in the schedule of a train, railway transport uses a signaling traffic control system. Railway signaling provides traffic control to trains and thereby helps to prevent accidents. The signaling system uses a significant portion of the infrastructure cost: it comprises up to 10% of the infrastructure expenses in Europe.

The state of the art railway safety system, known as signaling, is based on a technology which goes back to the 19th century. The principle of signaling is the following: trains are given permission by means of signals to move into the blocks, i.e. segments of railway track into which the railway lines are divided. The fundamental traffic management approach is to ensure that two trains are not allowed to occupy the same block at the same time. While in the early 19th century signals were given by railway officers by means of hand signals, this very primitive signaling system has gradually evolved to the Communication-Based Train Control (CBTC) where trains communicate with track equipment by means of radio signals.

For each block, on the side of the rails, hardware has to be installed to detect the presence of a train. If such a block is occupied by a train, no other train is allowed to enter it and, hence, such a train would be shown a signal, for example a red light. In this case, the train would have to fully stop and wait until the block is cleared and the signaling system shows the green light.

A drawback of this system is the low accuracy of the estimation of the position of the train: as it cannot resolve whether a train is at the beginning of the block or at the end of the block. In any case, the train trying to come into the same block will have to wait until the block is free, which is very inefficient. One way of increasing the efficiency is reducing the length of the blocks. However, this would increase the cost considerably and it is limited by the maximum length a train may have.

There is a substantial improvement in the most recent signaling system, called CBTC. The position of the trains is more precisely estimated by means of GPS equipment aboard the trains. In the CBTC system, trains communicate with hardware installed next to the tracks known as balises. The trains communicate with the balises at 2.4 GHz. The communication range this high frequency can attain is not very large in comparison with lower frequencies. Therefore, there has to be a balise installed in the rail infrastructure every few hundred meters. Typical distances would be about 300-500 meters; although in some cases it is necessary to install them at shorter distances, such as 50 m, if the channel characteristics are not good enough. The balises are usually interconnected through fiber. This way, the information a balise receives from a train in its close vicinity is propagated to the rest of the balises, and these can transmit this information to the trains in their vicinity. Hence, the trains have a more accurate knowledge of the position of the preceding trains on the track. CBTC can use mobile blocks instead of fixed blocks. A mobile block is defined around the train and its speed is varied to assure that no mobile blocks overlap. Compared to the fixed block signaling system, CBTC is clearly more traffic efficient, but still requires the installation of trackside hardware.

Therefore, the state of the art infrastructure-based safety systems do not provide a scalable solution. The more kilometers of railway, the higher would be the cost of equipment for safety and traffic management. The higher the traffic volume the lines should handle, the higher is the cost of safety.

Another limitation of prior art railway traffic management systems is that despite the existence of this cost-intensive system, the probability of failure is not negligible, as hardware error or human error leads to travel past stop signals. Besides accidents, signaling failure leads to delay. Therefore, it is clear that there is a need for a completely new safety system that increases safety and efficiency while reducing infrastructure and maintenance costs.

Legislation passed by the US Congress in 2008 mandates that "positive train control" (PTC) be installed by the end of 2015 on U.S. Class I rail main lines used to transport passengers or toxic-by-inhalation (TIH) materials.

"Positive train control" describes technologies designed to automatically stop or slow a train before certain accidents caused by human error occur. Specifically, PTC as mandated by Congress must be designed to prevent train-to-train collisions; derailments caused by excessive speed; unauthorized incursions by trains onto sections of track where maintenance activities are taking place; and the movement of a train through a track switch left in the wrong position.

A functioning PTC system must be able to determine the location and speed of trains, warn train operators of potential problems, and take action if the operator does not respond to a warning. For example, if a train operator fails to stop a train at a stop signal or slow down for a speed-restricted area, the PTC system would apply the brakes automatically. This might sound simple, but to work properly it requires highly complex technologies and information processing capabilities and communications systems able to incorporate and analyze the huge number of variables that affect rail operations. A simple example: the length of time it takes to stop depends on the terrain, weight and length of the train, the type of braking technology on the train, and other factors. A PTC system must be able to take all of these factors into account reliably and accurately.

Railroad operators are committed to meeting the PTC mandate and are working hard to make it happen, but it will be an enormous technical and financial undertaking. According to the FRA, railroads will have to spend around $5 billion to install PTC. Railroad operators think that the $5 billion estimate is way too low—their best estimate to date is that installation will cost $5.8 billion for freight railroads and another $2.4 billion for passenger railroads. Everyone agrees that PTC will require hundreds of millions of dollars each year to maintain. In total, according to FRA estimates, PTC will cost railroads up to $13.2 billion to install and maintain over 20 years".

In Europe, rail equipment manufacturers have developed over 20 signaling and speed-control systems, all of which are incompatible with each other. The European Commission has therefore called in 2005 for the gradual transition to a system that is common to the various EU member states: the European Rail Traffic Management System (ERTMS). This has two components:

(1) GSM-R, a radio communication system based on standard GSM (used by mobile telephones), but using various frequencies specific to rail;

(2) European Traffic Control System (ETCS), which not only allows permitted speed information to be transmitted to the driver, but also the driver compliance with these instructions.

GSM-R is built on GSM technology, and the benefits from the economies of scale of its GSM technology heritage, aiming at being a cost-efficient digital replacement for existing incompatible in-track cable and analog railway radio networks. GSM-R is part of the ERTMS standard and carries the signaling information directly to the train driver, enabling highest train speeds and traffic density with a high level of safety. GSM-R has been selected by 38 countries across the world, including all member states of the European Union (EU) and countries in Asia, Eurasia, and Northern Africa.

GSM-R is typically implemented using dedicated base station towers close to the railway. The distance between the base stations are 7-15 km. This creates a high degree of redundancy and higher availability and reliability. The train maintains a circuit switched digital modem connection to the train control center at all times. This modem operates with higher priority than normal users (eMLPP). If the modem connection is lost, the train will automatically stop. In Germany, Italy and France the GSM-R network has between 3000 and 4000 base stations. In Europe, GSM-R uses a specific frequency band:

876 MHz-880 MHz: used for data transmission (uplink)

921 MHz-925 MHz: used for data reception (downlink).

While the deployment of GSM-R, based on successful public GSM technology, is taking place quickly, ETCS has been developed specifically for the rail sector and will take longer. It requires the installation of a specific module on board the train and for the transducers on the track to use the same ETCS format. Given the long service life of rail equipment (more than 20 years), it is impossible to renovate the entire network at once. The Commission therefore estimates that it is inevitable that there will often be at least one system coexisting with ETCS on board and/or on the track.

The European Commission was planning a rapid migration strategy (within 10-12 years), with the aim of quickly reaching a critical mass of ETCS equipment. The entire rail sector also hopes that such a strategy can be implemented having endorsed a Memorandum of Understanding (MOU) on Mar. 17, 2005. In concrete terms, this entails investment amounting to $7 billion USD in order to reach the critical mass by 2016. In the current economic climate in Europe, it is very uncertain whether this goal can be reached by 2016.

ETCS enables ground-based equipment to transmit information to the train. This enables equipment on the trains to continuously calculate the maximum permitted speed. Information is transmitted by standardized beacons—Eurobalises—which are placed along the length of the track and connected to the existing signaling system. This is "ETCS Level 1" (ETCS-1). This technology is now mature, and Eurobalises can be purchased from several manufacturers.

In addition to ETCS-1, there are level 2 (ETCS-2) and level 3 (ETCS-3) systems as well. While the ETCS-2 and ETCS-3 systems do not use traffic lights on the sides of the rail tracks, they still use a centralized traffic control system in the form of a "Radio Block Center" which plays the role of a mediator between the trains (and onboard communications and computing equipment) and the sensors on the track (Eurobalises). Level 2 signaling system is an improvement over Level 1 in terms of efficiency and utilization. Level 3 (ETCS-3) holds the potential of having major benefits in terms of maintenance and operational capacity. Level 3 ETCS systems, however, are still at an experimental stage.

SUMMARY

In one aspect of the present disclosure, a system comprises a transceiver for receiving one or more communications from a communication device in a railway vehicle; a microcontroller that is configured for communication with the transceiver and that is configured to control a position of a switch in the railway; and an electronic subsystem for interfacing with the microcontroller and with the switch; wherein the transceiver is configured to transmit to the microcontroller at least one of the one or more communications received from the railway vehicle; wherein the microcontroller is configured to parse contents of the at least one of the one or more communications received from the transceiver; wherein the microcontroller is further configured to extract a command from the parsed contents; wherein the microcontroller is further configured to transmit the command to the electronic subsystem to cause the electronic subsystem to transition the switch to a position specified by the command; and wherein transitioning of the switch to the specified position enables the railway vehicle to cross the switch.

Implementations of the disclosure can include one or more of the following features. In some implementations, the position specified by the command is a first position in which the switch is in an occupied state; the at least one of the one or more communications that is transmitted to the microcontroller by the transceiver includes a request that the switch be transitioned to the first position; the transceiver is further configured to receive a clear message indicating that the railway vehicle has crossed the switch; the microcontroller is further configured to transmit another command to the electronic subsystem to cause the electronic subsystem to transition the switch to a second position corresponding to a free state, following receipt of the clear message indicating that the railway vehicle has crossed the switch; and the system promotes an interlocking functionality that comprises a transitioning of the switch between at least the first position and the second position. In still other implementations, the transceiver is further configured to: transmit, to the communication device in the railway vehicle, a request acknowledgement message that specifies that the switch is transitioned to the first position specified in the request; transmit, to the communication device in the railway vehicle, a clear acknowledgement message that specifies that the switch is transitioned to the second position in which the switch is in the free state; and transmit, to the communication device in the railway vehicle, a periodic packet that includes information indicative of a current position of the switch.

In still other implementations, the microcontroller is further configured to instruct the transceiver to transmit the one or more communications. In yet other implementations, the transceiver is configured for wireless communication with the railway vehicle. In still other implementations, the system is geographically located in proximity to the switch. In some implementations, the system promotes an interlocking functionality independent of a control center.

In still another aspect of the disclosure, a method performed by an interlocking system includes receiving one or more communications from a communication device in a railway vehicle of a railway system; parsing contents of at least one of the one or more communications; extracting a command from the parsed contents; determining that the command specifies that a switch in the railway system be transitioned from a first position to a second position; and transitioning the switch between the first position to the second position.

Implementations of the disclosure can include one or more of the following features. In some implementations, the interlocking system comprises an electronic subsystem and the electronic subsystem transitions the switch from the first position to the second position. In still other implementations, the position specified by the command is a first position in which the switch is in an occupied state; wherein the at least one of the one or more communications that is parsed includes a request that the switch be transitioned to the first position; wherein the method further comprises: receiving a clear message indicating that the railway vehicle has crossed the switch; and responsive to receipt of the clear message, transitioning the switch to a second position corresponding to a free state; and wherein the interlocking system promotes an interlocking functionality by transitioning the switch between the first position and the second position.

In still other implementations, the method includes transmitting, to the communication device in the railway vehicle, a request acknowledgement message that specifies the switch is transitioned to the first position specified in the request; transmitting, to the communication device in the railway vehicle, a clear acknowledgement message that specifies that the switch is transitioned to the second position in which the switch is in the free state; and transmitting, to the communication device in the railway vehicle, a periodic packet that includes information indicative of a current position of the switch. In yet other implementations, the interlocking system is geographically located in proximity to the switch. In still other implementations, the interlocking system promotes interlocking functionality at the switch, with the interlocking functionality being independent of operations performed by a control center.

In some implementations, the first position comprises an open position and wherein the second position comprises a closed position. In other implementations, the first position comprises a closed position and wherein the second position comprises an open position.

In still another aspect of the disclosure, one or more machine-readable media storing instructions that are executable by one or more processing devices of an interlocking system to perform operations comprising receiving one or more communications from a communication device in a railway vehicle of a railway system; parsing contents of at least one of the one or more communications; extracting a command from the parsed contents; determining that the command specifies that a switch in the railway system be transitioned from a first position to a second position; and causing the switch to transition from the first position to the second position. Implementations of this aspect of the present disclosure can include one or more of the foregoing features.

In yet another aspect of the disclosure, an interlocking system being located at a turnout in the railroad includes a transceiver for receiving a request message from a train, with the request message being wirelessly received over a global system for mobile communications—railway (GSM-R) network, and with the request message including a request to traverse the turnout; an electronic subsystem for switching the turnout between (i) a first position in which the switch is in a free state and is available for traversal, and (ii) a second position in which the switch is in an occupied state and is being traversed by a railway vehicle; and a microcontroller that is configured to (i) communicate with the electronic subsystem and with the transceiver, (ii) instruct the turnout to switch from the first position to the second position, following receipt of the request message, and (iii) instruct the turnout to switch from the second position to the first position, following receipt of a clear message from the train, with the clear message specifying that the train has crossed over the turnout; wherein the transceiver is configured to perform operations comprising: transmitting, to the train, a request acknowledgement message that specifies the turnout is switched to the second position in which the turnout is in the occupied state; receiving, from the train, the clear message that specifies that the train has crossed over the turnout; and transmitting, to the train, a clear acknowledgement message that specifies that the turnout is switched to the first position in which the turnout is in the free state.

All or part of the foregoing can be implemented as a computer program product including instructions that are stored on one or more non-transitory machine-readable storage media, and that are executable on one or more processing devices. All or part of the foregoing can be implemented as an apparatus, method, or electronic system that can include one or more processing devices and memory to store executable instructions to implement the stated functions.

The details of one or more implementations are set forth in the accompanying drawings and the description below. Other features will be apparent from the description and drawings, and from the claims.

BRIEF DESCRIPTION OF THE DRAWINGS

FIG. 4 is a flow chart showing an example of a process implemented by a vehicle approaching a turnout.

DETAILED DESCRIPTION

A system (e.g., an interlocking system) consistent with this disclosure manages rail transportation independent of centralized control centers. For example, the system manages interlocking functionality independent of centralized control centers. In this example, interlocking functionality can be performed without the use of centralized control; i.e., without using Operational Control Centers (OCC) and Radio Block Centers (RBC). In an example, use of a centralized control for interlocking functionality is obviated by utilizing an interlocking system, transportation vehicle schedules, and communications among transportation vehicles and the interlocking system (e.g., via base stations), as described in further details below. In this example, the system uses wireless communications system for performing the interlocking functionality of railway transportation systems (both inter-city and urban transport).

Figure 1A:
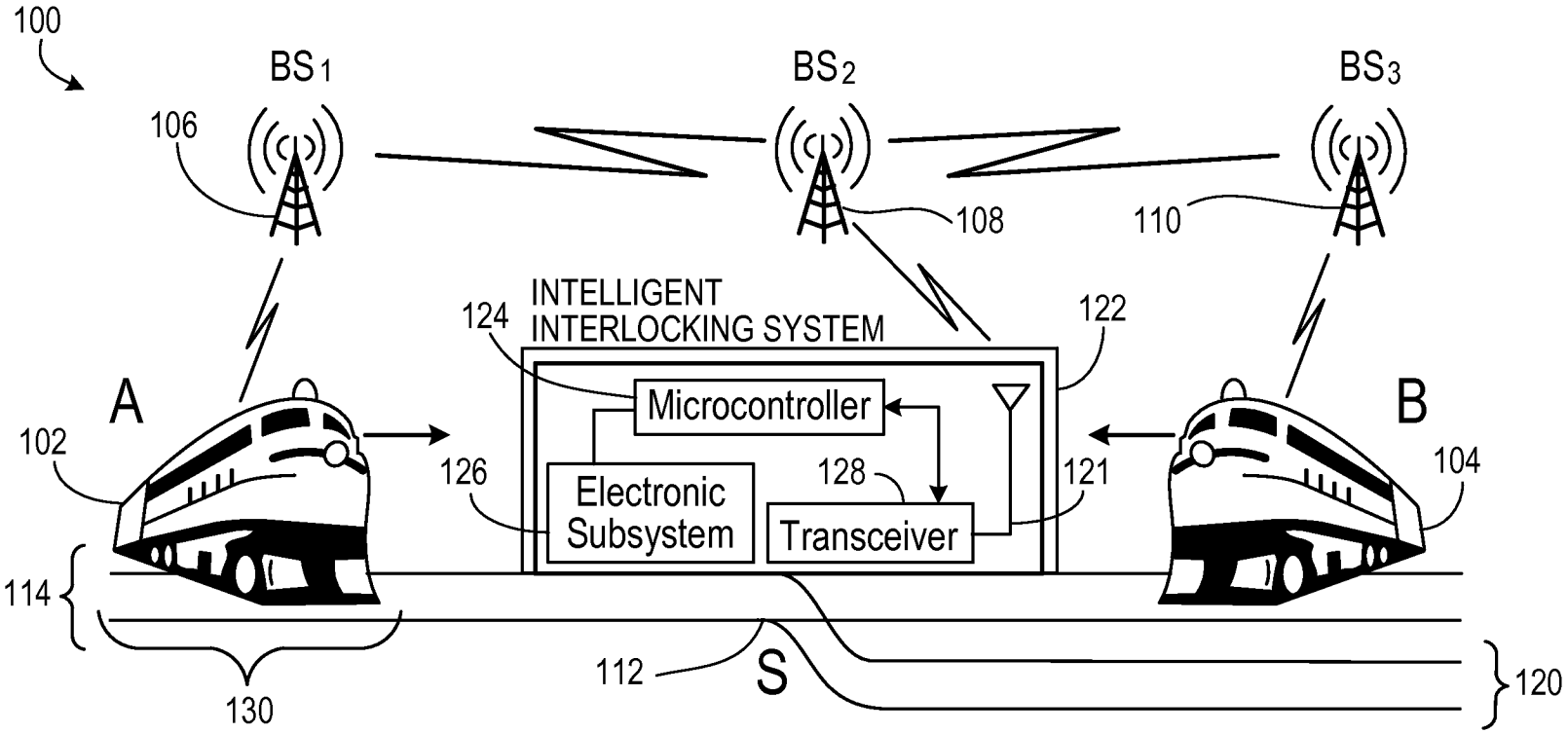
FIGS. 1A-1B show diagrams of environments for managing railway transportation.

Referring to FIG. 1A, environment 100 includes transportation vehicles 102, 104, base stations 106, 108, 110, switch 112, tracks 114, 120, and interlocking system 122. Environment 100 also includes a blade (not shown) on one of tracks 114, 120, which implements the movement of switch 112 from a first position to a second position (i.e., a "Straight Position" versus "Deviation Position"). The blade is mechanically connected to switch 112 to cause switch 112 to vary positions. Environment 100 also includes a power unit (not shown) to provide power for the interlocking system 122. The power unit may be a stand alone power unit or may be facilitated by a network operator. In an example, the power unit is connected to the interlocking system 122 to provide power to the interlocking system 122. In another example, the power unit is integrated in the interlocking system 122.

There are various types of transportation vehicles, including, e.g., trains and other railway vehicles. There are also various types of base stations, including, e.g., Global System for Mobile Communications—Railway (GSM-R) based cell towers. In this example, a request by transportation vehicle 102 is relayed through several base stations using wireless communications and interlocking system 122. Interlocking system 122 includes a system that promotes vehicle-to-vehicle communications to enable traffic management systems to eliminate/reduce additional infrastructure and includes algorithms for allocation of right-of-way to enhance traffic flow and to save energy. Generally, an interlocking system also includes an arrangement of signal apparatus that prevents conflicting movements through an arrangement of tracks such as junctions or crossings. There are various types of interlocking systems, including, e.g., a mechanical interlocking system, and electro-mechanical interlocking system, a relay interlocking system, and an electronic interlocking system (e.g., a solid state interlocking system). In this example, interlocking system 122 may be used to replace one or more of the above-listed types of interlocking systems.

Interlocking system 122 includes microcontroller 124, electronic subsystem 126, transceiver 128 and antenna 121. Microcontroller 124 includes a processing device that is configured for communication with electronic subsystem 126 and transceiver 128. Microcontroller 124 also controls a blade (not shown) on the track (e.g., one or more of tracks 114, 120), rather than the blade being controlled from the OCC and RBC through a Programmable Logic Array. The blade implements the movement of the switch 112 from a first position (e.g., a straight position) to a second position (e.g., a deviation position).

Electronic subsystem 126 includes an interface to microcontroller 124 and to the blade. Electronic subsystem 126 includes various electronic hardware and circuitry attached to the blade and moves the blade based on the commands coming from the microcontroller 124. In an example, electronic subsystem 126 includes a motor for switching the position of the blade and in turn the switch 112.

In some examples, electronic subsystem 126 and switch 112 may be integrated into a single device. For purposes of convenience and without limitation, switch 112 may also be referred to as turnout 112. Transceiver 128 is configured for communication with base stations 106, 108, 110. In this example, interlocking system 122 includes various functionality to promote communication, including e.g., omnidirectional and/or directional antennas (e.g., antenna 121) with an appropriate directivity, gain, and antenna type. Since the base stations 106, 108, 110 and switch 112 may have fixed locations, antenna 121 of the interlocking system 122 promotes good communications between one or more of base stations 106, 108, 110 and the interlocking system 122.

In the example of FIG. 1A, if both transportation vehicles 102, 104 are on time, no further action is necessary, as the switch 112 will be programmed to the deviation position at a specific time. In another example, due to various reasons, transportation vehicle 102 is late (with some delay) in crossing the switch 112 to track 120, then transportation vehicle 102 needs to take a deviation (or turnout) at the switch 112 and take the lower track 120 on the right hand side (RHS). In this example, using the GSM-R standard, transportation vehicle 102 sends a message to the transceiver 128 via base station 106, which relays this message to base station 108. When base station 108 relays or broadcasts this message, the transceiver 128 connected to the electronic subsystem 126 controlling the position of the turnout receives this message and activates the electronic subsystem 126 to switch to the deviation position (as opposed to the straight position). When base station 108 broadcasts this message, transportation vehicle 104 is also notified about the request of transportation vehicle 102 to switch the turnout (i.e., switch 112) to the deviation position. Based on this information, if necessary, transportation vehicle 104 can readjust its speed so as to accommodate the safe passage of transportation vehicle 102 to the lower railway 120 on the bottom right part of FIG. 1A.

After a short but finite time, the turnout 112 is moved to the desired position by the electronic subsystem 126 and the transceiver 128 at the turnout reports this back to base station 108. Subsequently, base station 108 relays this information back to transportation vehicle 102 and transportation vehicle 104 via base stations 106, 108, respectively. Based on these acknowledgment (ACK) messages, both transportation vehicles 102, 104 become aware of the new position of the turnout (i.e., the deviation position of turnout 112).

At this point in time, the interlocking functionality needed for safe passage of transportation vehicle 102 to the lower RHS railroad 120 has been completed. This interlocking functionality is achieved through wireless communications and a transceiver 128 that in communication with the electronic subsystem 126 (via microcontroller 124) at the turnout 112. This interlocking functionality is independent of an Operational Control Center (OCC), a Radio Block Center (RBC), hardwiring between an OCC, RBC, and the turnout, and human operators to monitor and to activate an infrastructure-based interlocking system. Interlocking system 122 promotes traffic control functionalities in rail transport (such as interlocking) via communications and/or wireless communications.

In the example of FIG. 1A, the communications between the base stations 106, 108, 110 and the transceiver 128 is secure and reliable, e.g., through the use of encryption techniques, authentication techniques, and other techniques such as error correction coding and spread spectrum techniques (such as frequency hopped spread spectrum techniques).

In an example, transportation vehicles 102, 104 are inter-city trains that are part of an inter-city rail transportation system. In this example, transportation vehicles 102, 104 run according to predefined schedules. Based on the predefined schedules, transportation vehicles 102, 104 cross turnouts or switches at designated times, e.g., rather than at random times. For example, according to a predefined schedule, transportation vehicle 102 crosses switch 112 (or a point of conflict) at 10:23 a.m. and only then (after transportation vehicle 102 crosses the switch 112) can transportation vehicle 104 use the track section 130 on which transportation vehicle 102 is currently on. In this example, transportation vehicle 102 monitors its speed continuously (and/or periodically) and, if possible, tries to readjust its speed to make up for any delays that might have incurred. If this is done, then the schedule is honored and everything functions according to the schedule using vehicle-to-vehicle communications based train control.

In another example, transportation vehicle 102 is a freight train and therefore it cannot accelerate beyond a certain limit to make up for lost time. In this example, if transportation vehicle 102 is running behind schedule, then a delay is unavoidable which will cause problems with the scheduled crossing time of transportation vehicle 102. For example, instead of crossing switch 112 at 10:23 AM, transportation vehicle 102 might be forced to cross the switch 112 at 10:26 AM (i.e., 3 minutes later than the scheduled time). If the transportation vehicle 104 in FIG. 1A was scheduled to cross the switch at 10:25 AM (i.e., 2 minutes after the transportation vehicle crosses the switch), then this will create a potential conflict that needs to be resolved. In some systems, such a delay would be handled by the interlocking capability of the centralized control which comprises the Operational Control Centers and Radio Block Centers. In the example of FIG. 1A, this interlocking capability will be handled by the transportation vehicles 102, 104 and the interlocking system 122 through wireless communications.

In an example, switches/turnouts have the schedules stored in memory (i.e., read only memory). The schedules may be transmitted to the switch in several different ways (e.g., by the rail network operator, rail operator, or even manually since the schedules do not change very frequently). In an example, changes in inter-city train schedules occur periodically (e.g., and are not frequent) and can easily be accommodated by the rail network operator. For example, if a rail network operator is using a computing device (i.e., a laptop running an operating system) that is connected a network (e.g., a local area network ("LAN"), a metropolitan area network ("MAN"), or a wide area network ("WAN"), and so forth), then any updates to the schedule can be done automatically and remotely. Changes in the schedule of inter-city trains could also be transmitted to the trains via the communications network used in rail transportation; e.g., by the GSM-R network, Internet, etc. In this example, schedule change should be conveyed to the trains using that rail track as well as the switches and the interlocking system.

In the example of FIG. 1A, transportation vehicle 102 continuously and/or periodically reports its position to a switch (i.e., switch 112) through the GSM-R network. Through these periodic reports, transportation vehicle 102 requests that the scheduled crossing time is delayed by three minutes. In this example, switch 112 and/or the interlocking system 122 gives priority according to the priority in the original schedule. If transportation vehicle 102 is scheduled to cross switch 112 first, then transportation vehicle 102 should have the priority in changing the schedule (even if both transportation vehicles 102, 104 are requesting to change the position of the switch 112). In this example, the switch 112 and/or interlocking system 122 maintains the relative order of priority in the original schedule. In this example, switch 112 includes a processor and software for accessing the schedule (stored in switch 112) and for maintaining and for changing orders of priority. In a variation of FIG. 1A, switch 112 may be included in interlocking system 122 and/or be separate from interlocking system 122. In this example, interlocking system 122 implements schedule changes (e.g., based on a schedule accessed from switch 112) and implements the interlocking functionality, e.g., based on communications received (via base stations) from the transportation vehicles. Based on these communications and the schedule, interlocking system 122 implements interlocking functionality (e.g., according to a schedule) that is independent of a centralized controller. In still another variation, interlocking system 122 may be configured to store a schedule.

In still another example, the schedules are not stored in the memory of turnouts and the position of switch 112 is set and managed by train-to-train communications. In this example, while the interlocking intelligence is still distributed (e.g., via interlocking systems), the intelligence pertaining to the schedules is placed into the mobile nodes (i.e., trains). In this example, the scheduling intelligence resides in the railway vehicles. Generally, intelligence refers to a series of instructions, commands and/or algorithms for performing an operation and/or for making various determinations.

In a variation of FIG. 1A, a wired connection (e.g., based on fiber optics or copper) exists between the transceiver 128 (FIG. 1A) and a base station configured for communication with transceiver 128. In still another variation, the tracks of the railway are used as a medium of communications between transportation vehicles 102, 104 and transceiver 128. In this example, the railroad (e.g., tracks 114, 120) acts as a waveguide to transmit control messages for changing the position of a turnout.

In yet another embodiment, power lines (not shown) providing the electricity for transportation vehicles 102, 104 are utilized to transmit the control messages from the transportation vehicles 102, 104 to the transceiver 128. This embodiment provides a cost-efficient alternative for electric trains' communications for controlling the setting or position of the turnout.

In another variation, the burden of periodic broadcasts of the transceiver 128 is reduced by the two transportation vehicles 102, 104 periodically communicating with a base station with increased proximity to the transceiver 128, e.g., relative to proximities of other base stations to the transceiver. In this example, the system architecture has increased autonomy because the transportation vehicles that need to resolve the conflict rely much more on the communications undertaken by the transportation vehicles themselves at short intervals. For this embodiment, camera-based systems at the base stations may be used to constantly monitor the position of the turnout so that this information is conveyed to the transportation vehicles upon receiving the query of the transportation vehicles.

In an example, various types of networks (e.g., GSM-R networks, the Internet, and so forth) are used for the transmission of control messages from transportation vehicles 102, 104 to the transceiver 128. In still another example, satellite communications are used for the transmission of control messages from transportation vehicles 102, 104 to the transceiver 128. In still another example, uplink and/or downlink (communications) between a base station and the interlocking system 122 could also be based on wired links.

In another example, a transportation vehicle includes a communication and/or storage device for storage for a schedule of the transportation vehicle on a given route. That is, a transportation vehicle knows its own schedule on a given route. This schedule information could be transmitted to the device of the transportation vehicle through a secure GSM-R network of the network operators, through Internet, or other means. Through this communication device in the transportation vehicle, if there is a delay involved in the arrival time of one of the other transportation vehicles, this schedule information is transmitted to the transceiver and the turnout so that the turnout is kept in the right position for the additional time due the delay experienced by one or both of the transportation vehicles.

In a variation of FIG. 1A, the interlocking system 122 may include various other subsystems (in addition to or instead of the electronic subsystem 126, transceiver 128 and microcontroller 124) to perform the functionality of the interlocking system 122 described herein. For example, the interlocking system 122 may include various electronic subsystems, mechanical subsystems, electro-mechanical subsystems, other solid-state devices, magnetic devices, etc.

As previously described, the interlocking system 122 operates independent of operational control centers (OCC) and other centralized control paradigms. This independent operation is based on the interlocking operation and several other tasks such as train detection and dynamic speed adjustment based on the positions of trains, as described in U.S. Provisional Patent Application 61/632,520, the entire contents of which are incorporated herein by reference.

In still another variation, the interlocking system 122 may be implemented in an intra-city rail transportation environment. In this example, the environment uses a cellular network or a wireless (WiFi) network for underground transportation vehicles, e.g., rather than using a GSM-R network. There are various cellular networks, including, e.g., a GSM network, a Code Division Multiple Access (CDMA) network, a Long Term Evolution (LTE) network, a LTE-Advanced (LTE-A), and so forth. In this example, rather than using base stations, the environment may implement access points in WiFi networks to implement the interlocking functionality shown in FIG. 1A (via an interlocking system) for intra-city rail. In this example, rather than wireless communications between a base station and the interlocking system 122 (as shown in FIG. 1A), an intra-city rail transportation environment may include either wired or wireless communications between an access point/base station and the interlocking system. In this example, the intra-city rail transportation environment (with the interlocking system described herein) manages traffic control for an underground metro, e.g., without centralized control in the form of OCC and RBC.

Figure 1B:
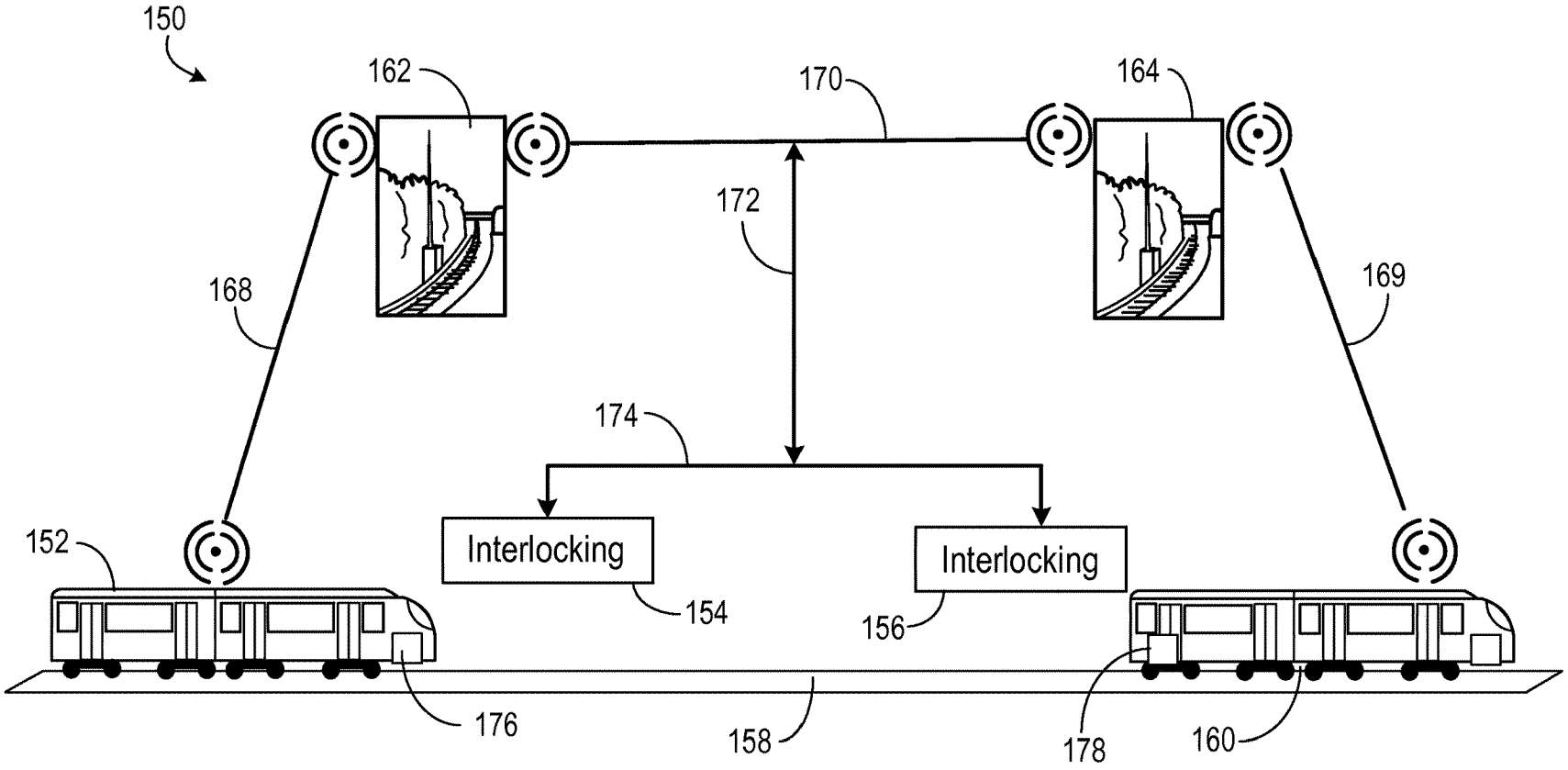

Referring to FIG. 1B, environment 150 includes railway vehicles 152, 160, interlocking systems 154, 156, railway 158, base stations 162, 164, and communication links 168, 170, 172, 174. In this example, railway 158 includes a railway track that is part of a railway system (e.g., a railroad). Generally, a communication link includes a communication channel that connects communicating devices, e.g., via a communication network, a wireless device, and so forth.

In the example of FIG. 1B, railway vehicles 152, 160 include communication devices 176, 178. Generally, a communication device is hardware that is configured for communication with other hardware, including, e.g., a base station. In this example, communication devices 176, 178 enable railway vehicles 152, 160, respectively, to communicate with one or more of base stations 162, 164. In this example, railway vehicle 152 communicates with base station 162 via communication link 168, e.g., by transmitting a REQ packet. In the example of FIG. 1B, base station 162 transmits the REQ packet to base station 164, via communications link 170, and to interlocking system 154, via communications link 174. That is, when base station 162 re-broadcasts the REQ packet, a transceiver (not shown) in interlocking system 154 receives the rebroadcast. Following receipt of the REQ packet, interlocking system 154 implements the control software described herein to promote interlocking at a switch (not shown) in proximity to railway vehicle 152.

In this example, railway vehicle 160 communicates with base station 166 via communication link 169, e.g., by transmitting a REQ packet. In the example of FIG. 1B, base station 164 transmits the REQ packet to base station 162, via communications link 170, and to interlocking system 156, via communications link 174. Following receipt of the REQ packet, interlocking system 156 implements the control software described herein to promote interlocking at a switch (not shown) in proximity to railway vehicle 160.

Figure 2:
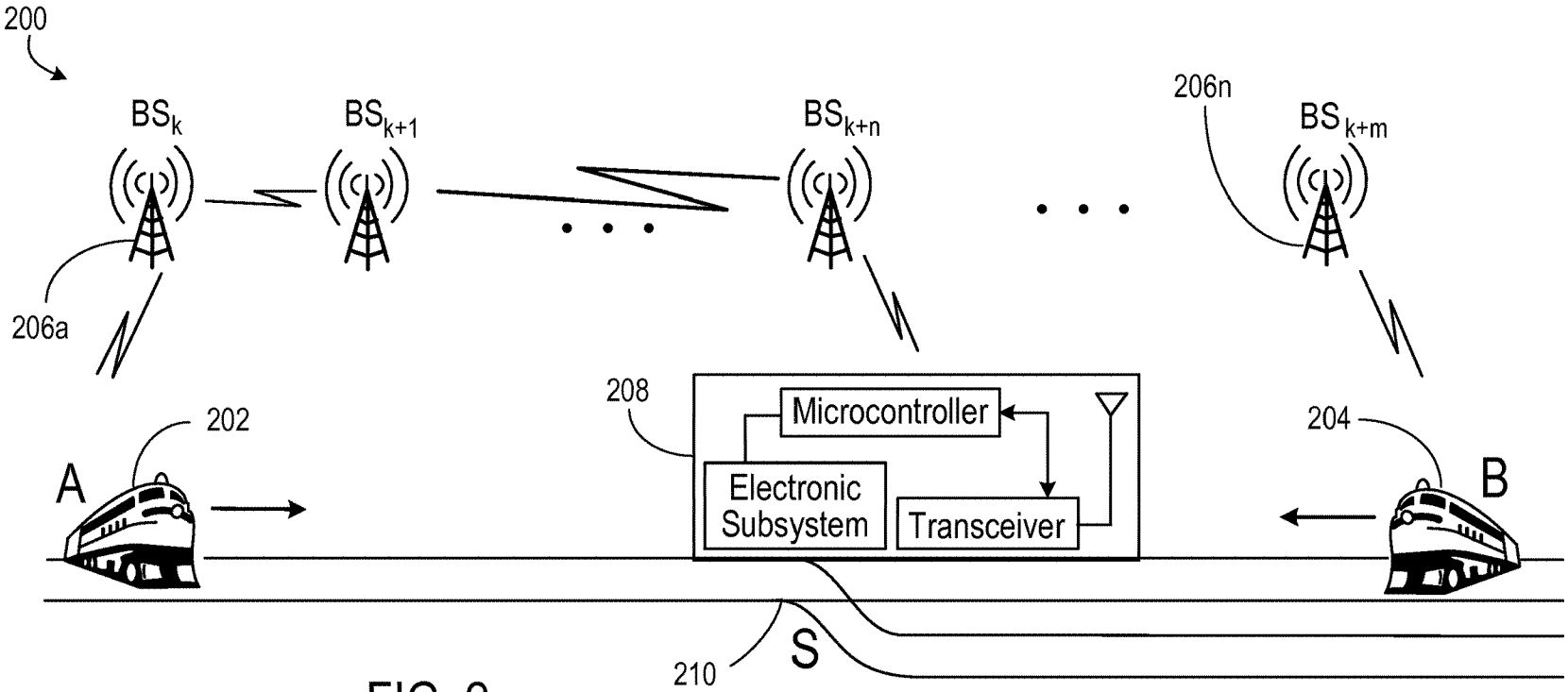
FIG. 2 shows a diagram of an environment for managing railway transportation in which information is relayed through several base stations.

Referring to FIG. 2, environment 200 includes transportation vehicles 202, 204, base stations 206*a* . . . 206*n*, interlocking system 208 and switch 210. In the example of FIG. 2, the relaying between a source (e.g., one of transportation vehicles 202, 204) and switch 210 involves several base stations (e.g., base stations 206*a* . . . 206*n*).

Figure 3:
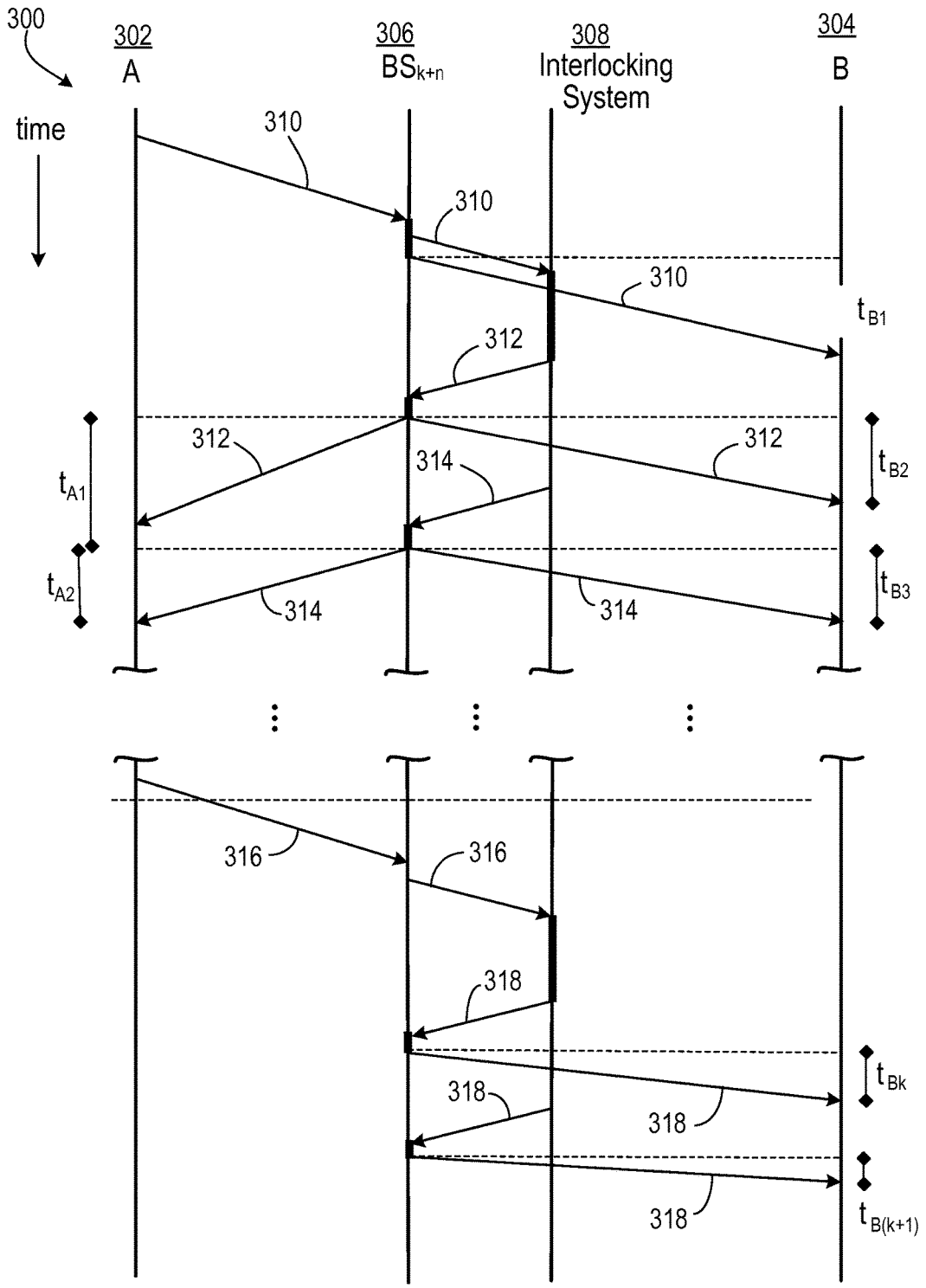
FIG. 3 shows a schematic timing diagram of communications in an environment for managing railway transportation.

Referring to FIG. 3, a timing diagram 300 of the communications between the transportation vehicles 302, 304, a base station 306 and an interlocking system 308 is shown. In this example, transportation vehicle 302 needs to take a deviation (or turnout) at a switch 112. In this example, using the GSM-R standard, transportation vehicle 302 sends a message 310 to the interlocking system 308 via base station 306. In this example, base station 306 relays message 310 to interlocking system 308 and to base station 304. When base station 306 relays or broadcasts this message 310, the interlocking system 308 receives this message 310 and activates an electronic subsystem (in an interlocking system) to switch to the deviation position (as opposed to the straight position) to promote interlocking. Based on message 310, transportation vehicle 304 can readjust its speed so as to accommodate the safe passage of transportation vehicle 302 (e.g., safe passage to the lower railway 120 on the bottom right part of FIG. 1A).

After the interlocking is achieved, the interlocking system 308 periodically broadcasts its state via broadcast messages 312, 314 to nearby base station 306 (i.e., $BS_{k+n}$). After the turnout switches to the deviation position, each broadcast message (i.e., broadcast messages 312, 314) by the interlocking system 308 first reaches the close-by base stations (i.e., base station 306) and the broadcast is relayed to transportation vehicles 302, 304. This is done to make sure that the state of the turnout is continuously conveyed to transportation vehicles 302, 304 in short intervals, e.g., every 100 milliseconds. In this example, the time taken for each consecutive broadcast to reach transportation vehicles 302, 304 will take less time as transportation vehicles 302, 304 are moving and quickly approaching the turnout. In the example of FIG. 3, $t_{A1}>t_{A2}>t_{A3} \ldots >t_{A(N-1)}>t_{AN}$ and $t_{B1}>t_{B2}>t_{B3} \ldots >t_{B(N-1)}>t_{BN}$.

This periodic broadcasting by the interlocking system 308 continues until transportation vehicle 302 crosses a turnout (i.e., turnout 210 to the lower rail on the right hand side of FIG. 2), at which point transportation vehicle 302 sends a message 316 to the base station 306 informing it that transportation vehicle 302 has crossed the turnout. This message is relayed to the interlocking system 308 and triggers the change of position in the turnout to the straight position. After this is completed, the new position is broadcast (via broadcast message 318) to transportation vehicle 304 through the existing base stations, thus enabling transportation vehicle 304 to continue its motion by readjusting its speed (or resume its motion if it was forced to stop). Interlocking system 308 continues to broadcast the broadcast message 318, e.g., until transceiver receives confirmation from transportation vehicle 304 that transportation vehicle 304 has received broadcast message 318. In another example, three-way handshaking (not shown in the timing diagram of FIG. 3) between transportation vehicles 302 and 304, in addition to the signaling scheme shown in FIG. 3, might be possible. By periodically (e.g., every 100 msec) exchanging messages that include information on the identity, heading, speed, location, etc. of the two transportation vehicles approaching the switch, the safety of the disclosed environment can be further increased (e.g., relative to the safety of other environments) or maximized. Such an implementation could be pursued, as an example, for a fail-safe system design. The information exchanged using this three-way handshaking may used either in a stand-alone fashion or in conjunction with the other information sent to the two transportation vehicles by the interlocking system.

The system described herein uses various, different types of packets, including the following types. One type of packet is a request packet (REQ) that is a message requesting to pass through a point of conflict. For example, a first train that is scheduled to cross a point of conflict (e.g., a turnout) transmits the request packet to the transceiver that is connected to the turnout.

Another type of packet is an acknowledgment of the REQ packet (REQ-ACK). In an example, the transceiver of the turnout transmits the acknowledgment packet to notify the train that originates the REQ packet when the turnout has moved to the desired position. Still another type of packet is a clear packet (CLR). For example, a transportation vehicle (e.g., transportation vehicle 102 in FIG. 1A) sends out a clear packet to the transceiver at the turnout when it crosses the turnout. This clear packet allows other trains to continue their motion and cross the turnout in a safe manner.

Another type of packet is an acknowledgment of the CLR packet (CLR-ACK). In an example, the transceiver of the turnout at the point of conflict transmits an acknowledgment packet to notify other trains that the turnout is released and can be used by other trains. Still another type of packet is a periodic packet (PRD). In this example, the transceiver periodically sends out a packet to inform all trains of its current position. Periodic packets are continuously transmitted until the trains that need to use the turnout already cross the turnout (i.e., triggered by the reception of the clear packet).

Referring to FIG. 4, vehicle performs process 400 in promoting vehicle-to-vehicle communication. In operation, a transportation vehicle remains idle (402) and then subsequently approaches a turnout. The transportation vehicle performs (404) conflict resolution. The transportation vehicle determines (406) whether a conflict is detected. If a conflict is detected, the transportation vehicle determines (408) if it is the first vehicle to cross the turnout. If the transportation vehicle is the first to cross the turnout, the transportation vehicle transmits (412) a REQ packet to the turnout (i.e., to the interlocking system of the turnout). In this example, the REQ packet is received by a transceiver in the interlocking system. The transceiver parses the REQ packet and sends to the microcontroller the content of the REQ packet. In response, the microcontroller cause an electronic subsystem connected to the blades of the switch to move the switch to a deviation position. At action 406, if a conflict is not detected, the transportation vehicle performs action 412.

The transportation vehicle determines (418) if a REQ-ACK packet is received from the interlocking system. If a REQ-ACK packet is received, the transportation vehicle determines (426) that it is safe for the transportation vehicle to cross the turnout. The transportation vehicle also determines (430) whether the turnout is crossed. If the transportation vehicle determines that the turnout is crossed, then the transportation vehicle transmits (432) a CLR packet to the interlocking system. The transportation vehicle also determines (434) if a CLR-ACK packet is received from the interlocking system. If a CLR-ACK packet is received, then process 400 is complete. If a CLR-ACK packet is not received, the transportation vehicle repeats action 432, e.g., until the transportation vehicle receives a CLR-ACK packet.

At action 430, if the transportation vehicle determines that the turnout has not yet been crossed (by the transportation vehicle), the transportation vehicle repeats action 426, e.g., until the transportation vehicle determines that the turnout is crossed.

At action 418, if the transportation vehicle determines that a REQ-ACK packet is not received, the transportation vehicle determines (420) whether a safety distance to the turnout is reached by the transportation vehicle. If the safety distance to the turnout is not reached by the transportation vehicle, the transportation vehicle repeats action 412 of transmitting the REQ packet to the interlocking system. If the safety distance to the turnout is reached by the transportation vehicle, the transportation vehicle repeats stops (422) movement and transmits (424) a REQ packet to the interlocking system. The transportation vehicle determines (428) if a REQ-ACK packet is received from the interlocking system. If a REQ-ACK packet is received from the interlocking system, the transportation vehicle determines (426) that it is safe to cross the turnout. If a REQ-ACK packet is not received from the interlocking system, the transportation vehicle repeats action 424.

At action 408, if the transportation vehicle determines that it is not the first to cross the turnout when there is a conflict, the transportation vehicle slows down (410). Following the slow down, the transportation vehicle determines (414) if a CLR-ACK packet is received from the interlocking system. If a CLR-ACK packet is received, the transportation vehicle performs action 412. If a CLR-ACK packet is not received, the transportation vehicle determines (416) if the safety distance to the turnout is reached. If the safety distance is not reached, the transportation vehicle repeats action 410, e.g., until the safety distance is reached. If the safety distance is reached, the transportation vehicle performs action 422 and continues with process 400 as shown in FIG. 4.

Figure 5:
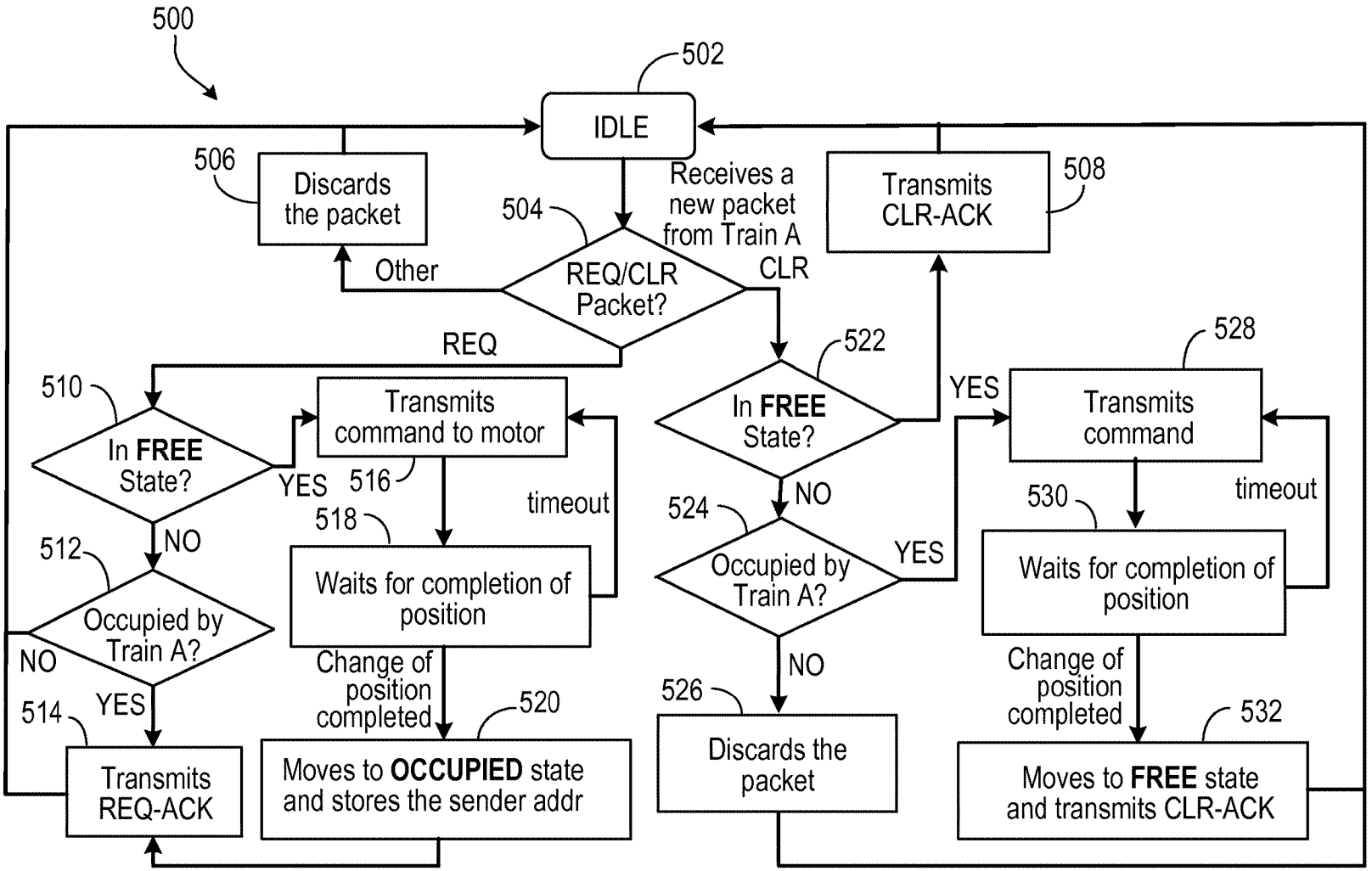
FIG. 5 is a flow chart showing an example of a process implemented by an interlocking system.

Referring to FIG. 5, an interlocking system performs process 500 in promoting vehicle-to-vehicle communication that is independent of a central controller. In operation, the interlocking system is idle and receives (502) a packet from a transportation vehicle. In this example, the transceiver in the interlocking system received the packet. The interlocking system determines (504) whether the received packet it a REQ packet or a CRL packet. In an example, the microcontroller in the interlocking system makes this determination, e.g., based on examining contents of the received packet.

If the interlocking system determines that the received packet is REQ packet, the interlocking system determines (510) if the turnout is in a free state, e.g., a state in which the turnout is unoccupied. If this interlocking system determines that the turnout is in a free state, the interlocking system transmits (516) the REQ packet (and/or a command included in the REQ packet) to the motor in the interlock system. For example, the microcontroller in the interlocking system may make the determination that the turnout is in a free state. In this example, the microcontroller transmits the REQ packet and/or the command included in the REQ packet to the electronic subsystem. In this example, the command is to switch the turnout to a deviation position.

The interlocking system waits (518) for the electronic subsystem to complete its switching to another position (i.e., a deviation position). In this example, the interlocking system is configured to wait for a predetermined period of time. If the amount of time that the interlocking system is waiting exceeds the predetermined period of time, the interlocking system implements a timeout operation to cease waiting and repeats action 516. Once the change of position is completed, the interlocking system transitions (520) to an occupied state and stores the address of the sender (i.e., the vehicle that sent the REQ packet). An occupied state includes a state in which the turnout is occupied by a vehicle. The interlocking system transmits (514) a REQ-ACK packet to the transportation vehicle that sent the REQ packet and returns to an idle state at action 502.

At action 510, if the interlocking system determines that the turnout is not in a free state, the interlocking system determines (512) if the turnout is occupied by a transportation vehicle. If the turnout is occupied by a transportation vehicle, the interlocking system transmits (514) a REQ-ACK packet to the transportation vehicle that sent the REQ packet. If the turnout is not occupied by a transportation vehicle, the interlocking system returns to an idle state at action 502.

At action 504, if the interlocking system determines that the received packet is CLR packet, the interlocking system determines (522) if the turnout is in a free state, e.g., a state in which the turnout is unoccupied. If this interlocking system determines that the turnout is in a free state, the interlocking system transmits (508) a CLR-ACK packet to the transportation vehicle that sent the CLR packet and returns to an idle state at action 502.

At action 522, if the interlocking system determines that the turnout is not in a free state, the interlocking system determines (524) if the turnout is occupied by a transportation vehicle. If the interlocking system determines that the turnout is not occupied by a transportation vehicle, the interlocking system discards (526) the CLR-ACK packet and returns to an idle state at action 502.

If the interlocking system determines that the turnout is occupied by a transportation vehicle, the interlocking system transmits (528) to the motor a command to switch to another position (e.g., a deviation position, an alternate position, a straight position, and so forth). The interlocking system waits (530) for the motor to complete its switching to another position (i.e., a deviation position). In this example, the interlocking system is configured to wait for a predetermined period of time. If the amount of time that the interlocking system is waiting exceeds the predetermined period of time, the interlocking system implements a timeout operation to cease waiting and repeats action 516. Once the change of position is completed, the interlocking system transitions (532) to a free state and transmits a CLR-ACK message to the transportation vehicle that sent the CLR message.

At action 504, if the interlocking system determines that the received message is neither a REQ packet nor a CLR packet, the interlocking system discards (506) the packet.

In an example, an increased amount of intelligence is associated with the transceiver in a secure GSM-R based network which is operated by a government authority or by a private railroad operator. In such a case, train schedules can be distributed to these transceivers by the railroad operator using a secure network and the transceiver might have additional computing capabilities (such as a CPU, memory, I/O bus, etc.). In such implementations, lookup tables could be used to change the position of the turnout in conjunction with the envisioned communications between the trains, base stations, and the transceiver connector to the electronic subsystem. For such possible implementations, the signaling algorithms and the associated timing diagrams may differ from the one shown in FIG. 3. This embodiment increases an amount of intelligence included in the transceiver-motor subsystem for traffic control in rail transportation. The embodiment in FIG. 3 increases an amount of intelligence in the "mobile nodes" of the network (i.e., the trains) and attempts to resolve the conflict via the communications between trains and trains and the turnouts (or switches).

Figure 6:
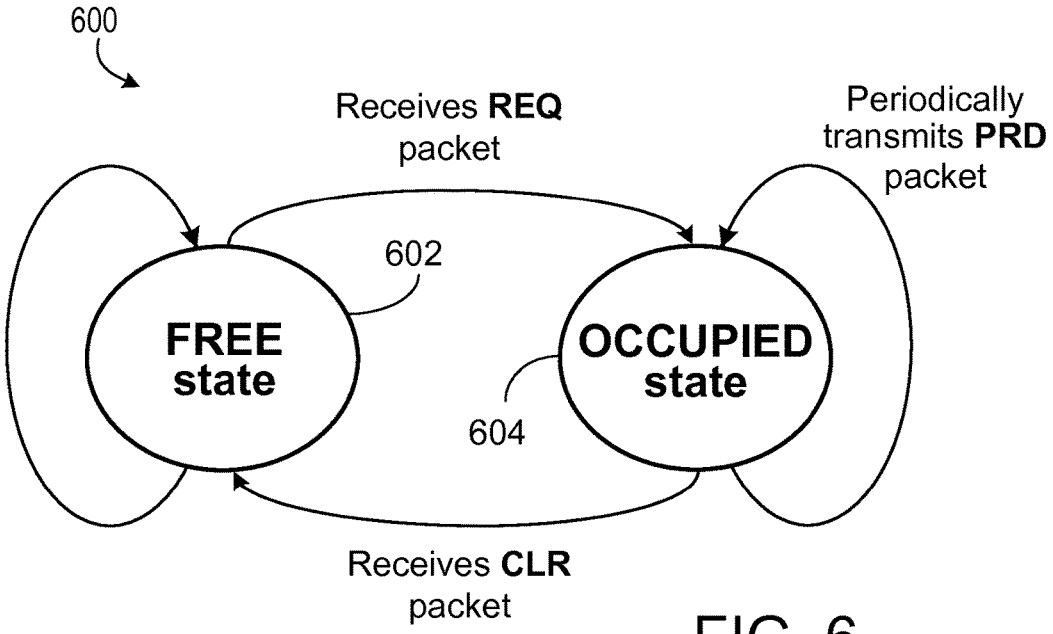
FIG. 6 shows a schematic of a state representation.

Referring to FIG. 6, diagram shows representation 600 of a state machine that is modeled after a turnout. Representation 600 includes free state 602 and occupied state 604. In the example of FIG. 6, the turnout remains in the same state (either a free state 602 or an occupied state 604 corresponding to the straight or deviation position, respectively) as long as no change of state request message is received (by an interlocking system) from a transportation vehicle (e.g., one of transportation vehicles 102, 104 in FIG. 1A). When such a message is received, a state of the turnout changes to the other state and remains in that state until a new request is received from one of the trains to change its state. Furthermore, the turnout uses the interlocking system to broadcast its state or status through its transmitter and a PRD packet periodically to the nearby GSM-R base station.

In this example, the turnout is in a free state 602 and remains in a free state 602 until it receives a REQ packet. Upon receipt of the REQ packet, the interlocking system switches the turnout to an occupied state 604, and the turnout remains in the occupied state 604 until it receives a CLR packet. Upon receipt of the CLR packet, the interlocking system switches the turnout back to a free state 602. In the occupied state 604, the interlocking system periodically transmits PRD packets.

Figure 7:
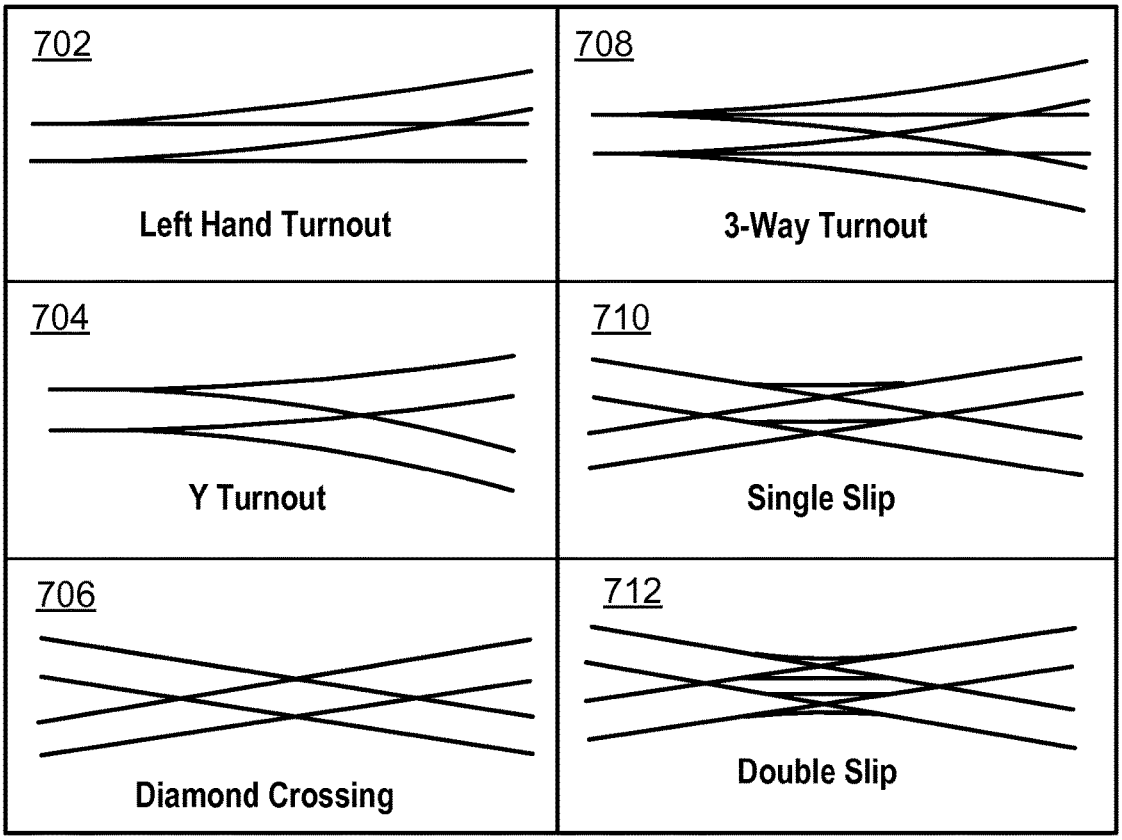
FIG. 7 shows schematics of different types of turnouts used on railroads.

In an example, there are several types of turnouts and high-speed switches that may be used with the interlocking system described herein. Referring to FIG. 7, various types of turnouts are shown, including turnout types 702, 704, 706, 708, 710, 712. In an example, a state machine representation of a turnout will vary for the various types of turnout. For example, for 3-way Turnout 708, a state machine representation will have 3 different states corresponding to an occupied state.

Implementations of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Implementations of the subject matter described in this specification can be implemented as one or more computer programs, i.e., one or more modules of computer program instructions encoded on a tangible program carrier for execution by, or to control the operation of, a processing device. Alternatively or in addition, the program instructions can be encoded on a propagated signal that is an artificially generated signal, e.g., a machine-generated electrical, optical, or electromagnetic signal that is generated to encode data for transmission to suitable receiver apparatus for execution by a processing device. The machine-readable medium can be a machine-readable storage device, a machine-readable storage substrate, a random or serial access memory device, or a combination of one or more of them.

The term "processing device" encompasses all kinds of apparatus, devices, and machines for processing data, including by way of example a programmable processor, a computer, or multiple processors or computers. The processing device can include special purpose logic circuitry, e.g., an FPGA (field programmable gate array) or an ASIC (application-specific integrated circuit). The processing device can also include, in addition to hardware, code that creates an execution environment for the computer program in question, e.g., code that constitutes processor firmware, a protocol stack, a database management system, an operating system (OS), or a combination of one or more of them.

A computer program (which may also be referred to as a program, software, a software application, a script, or code) can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable computers executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Computers suitable for the execution of a computer program include, by way of example, general or special purpose microprocessors or both, or any other kind of central processing unit. Generally, a central processing unit will receive instructions and data from a read-only memory or a random access memory or both. The essential elements of a computer are a central processing unit for performing or executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube) or LCD (liquid crystal display) monitor, for displaying data to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network (LAN) and a wide area network (WAN), e.g., the Internet.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of any of what may be claimed, but rather as descriptions of features that may be specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Particular implementations of the subject matter have been described. Other implementations are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

What is claimed is:

1. A system comprising:

a transceiver for receiving one or more communications from a communication device in a railway vehicle and from one or more remote devices of an interlocking system;

a microcontroller that is configured for communication with the transceiver and that is configured to control a position of a switch in a railway;

storage for storing a predefined schedule indicative of scheduled operations of the switch; and an electronic subsystem for interfacing with the microcontroller with the switch;

wherein the transceiver is configured to transmit to the microcontroller at least one of the one or more communications received from the railway vehicle;

wherein the microcontroller is configured to parse contents of the at least one of the one or more communications received from the transceiver;

wherein the microcontroller is further configured to determine, autonomously, from the parsed contents of the at least one of the one or more communications, i) a current location of the railway vehicle relative to the switch, and ii) that the railway vehicle has priority over other vehicles for accessing the railway by comparing the current location of the railway vehicle relative to the switch to an expected location of the railway vehicle relative to the switch, with the expected location being indicated by the predefined schedule that is stored in the storage;

wherein the microcontroller is further configured to extract a command from the parsed contents;

wherein the microcontroller is further configured to transmit the command to the electronic subsystem, in response to autonomously determining that the railway vehicle has priority for accessing the railway, to cause the electronic subsystem to transition the switch to a position specified by the command;

wherein the microcontroller is further configured, in response to the transition, to autonomously update the predefined schedule;

wherein the microcontroller is further configured to cause the transceiver to distribute the update of the predefined schedule to the one or more remote devices of the interlocking system;

wherein transitioning of the switch to the specified position enables the railway vehicle to cross the switch; and wherein the system promotes an interlocking functionality independent of a control center.

2. The system of claim 1, wherein the first position is a position in which the switch is in an occupied state;

wherein the at least one of the one or more communications that is transmitted to the microcontroller by the transceiver includes a request that the switch be transitioned to the first position;

wherein the transceiver is further configured to receive a cleared message indicating that the railway vehicle has crossed the switch;

wherein the microcontroller is further configured to transmit another command to the electronic subsystem to cause the electronic subsystem to transition the switch to a second position corresponding to a free state, following receipt of the cleared message indicating that the railway vehicle has crossed the switch; and wherein the system promotes an interlocking functionality that comprises a transitioning of the switch between at least the first position and the second position.

3. The system of claim 2, wherein the transceiver is further configured to:

transmit, to the communication device in the railway vehicle, a request acknowledgement message that specifies that the switch is transitioned to the first position specified in the request;

transmit, to the communication device in the railway vehicle, a cleared acknowledgement message that specifies that the switch is transitioned to the second position in which the switch is in the free state; and transmit, to the communication device in the railway vehicle, a periodic packet that includes information indicative of a current position of the switch.

4. The system of claim 1, wherein the microcontroller is further configured to instruct the transceiver to transmit the one or more communications.

5. The system of claim 1, wherein the transceiver is configured for wireless communication with the railway vehicle.

6. The system of claim 1, wherein the system is affixed to a portion of the switch.

7. The system of claim 1, wherein the system further comprises an antenna to promote receipt of communications.

8. The system of claim 1, wherein the microcontroller is a first microcontroller, and wherein the first microcontroller is configured to send, using the transceiver, additional communications to a second microcontroller that is configured to control a position of a second switch in the railway, wherein the additional communications are transmitted from the first microcontroller to the second microcontroller via one or more base stations, one or more railway vehicles, or both a base station and a railway vehicle.

9. The system of claim 1, wherein the microcontroller is physically connected to the switch via the electronic subsystem.

10. A method performed by a device of an interlocking system, the method comprising:

receiving one or more communications from a communication device in a railway vehicle of a railway system;

parsing contents of at least one of the one or more communications;

autonomously determining, from the parsed contents of the at least one of the one or more communications, i) a current location of the railway vehicle relative to the switch, and ii) that the railway vehicle has priority over other vehicles for accessing the railway system by comparing the current location of the railway vehicle relative to the switch to an expected location of the railway vehicle relative to the switch as indicated by a predefined schedule for the switch;

extracting a command from the parsed contents;

determining that the command specifies that a switch in the railway system be transitioned from a first position to a second position;

transitioning, using a subsystem, in response to autonomously determining that the railway vehicle has priority for accessing the railway system, the switch between the first position to the second position;

in response to the transitioning, autonomously updating the predefined schedule;

distributing the update of the predefined schedule to one or more other devices of the interlocking system; and wherein the device of the interlocking system promotes an interlocking functionality independent of a control center.

11. The method of claim 10, wherein the subsystem comprises an electronic subsystem for transitioning the switch from the first position to the second position in response to the determination.

12. The method of claim 10, wherein the first position is a position in which the switch is in an occupied state;

wherein the at least one of the one or more communications that is parsed includes a request that the switch be transitioned to the first position;

wherein the method further comprises:

receiving a cleared message indicating that the railway vehicle has crossed the switch; and responsive to receipt of the cleared message, transitioning the switch to a second position corresponding to a free state; and wherein the interlocking system promotes an interlocking functionality by transitioning the switch between the first position and the second position.

13. The method of claim 12, further comprising one or more of:

transmitting, to the communication device in the railway vehicle, a request acknowledgement message that specifies the switch is transitioned to the first position specified in the request;

transmitting, to the communication device in the railway vehicle, a cleared acknowledgement message that specifies that the switch is transitioned to the second position in which the switch is in the free state; and transmitting, to the communication device in the railway vehicle, a periodic packet that includes information indicative of a current position of the switch.

14. The method of claim 10, wherein the interlocking system is affixed to a portion of the switch.

15. The method of claim 10, wherein the interlocking system promotes interlocking functionality at the switch.

16. The method of claim 10, wherein the first position comprises an open position and wherein the second position comprises a closed position.

17. The method of claim 10, wherein the first position comprises a closed position and wherein the second position comprises an open position.

18. One or more non-transitory machine-readable hardware storage devices storing instructions that are executable by one or more processing devices of an interlocking system to perform operations comprising:

receiving one or more communications from a communication device in a railway vehicle of a railway system;

parsing contents of at least one of the one or more communications;

autonomously determining, from the parsed contents of the at least one of the one or more communications, i) a current location of the railway vehicle relative to the switch, and ii) that the railway vehicle has priority over other vehicles for accessing the railway system by comparing the current location of the railway vehicle relative to the switch to an expected location of the railway vehicle relative to the switch as indicated by a predefined schedule for the switch;

extracting a command from the parsed contents;

determining that the command specifies that a switch in the railway system be transitioned from a first position to a second position;

causing, in response to autonomously determining that the railway vehicle has priority for accessing the railway system, the switch to transition from the first position to the second position;

autonomously updating the predefined schedule; and causing distribution of the update of the predefined schedule to one or more remote processing devices of the interlocking system;

wherein the interlocking system promotes interlocking functionality independent of operations performed by a control center.

19. The one or more non-transitory machine-readable hardware storage devices of claim 18, wherein the first position is a position in which the switch is in an occupied state;

wherein the at least one of the one or more communications that is parsed includes a request that the switch be transitioned to the first position;

wherein the operations further comprise:

receiving a cleared message indicating that the railway vehicle has crossed the switch; and responsive to receipt of the cleared message, causing the switch to transition from a second position corresponding to a free state; and wherein the interlocking system promotes an interlocking functionality by transitioning the switch between the first position and the second position.

20. The one or more non-transitory machine-readable hardware storage devices of claim 18, wherein the operations further comprise:

transmitting, to the communication device in the railway vehicle, a request acknowledgement message that specifies the switch is transitioned to the first position specified in the request;

transmitting, to the communication device in the railway vehicle, a cleared acknowledgement message that specifies that the switch is transitioned to the second position in which the switch is in the free state; and transmitting, to the communication device in the railway vehicle, a periodic packet that includes information indicative of a current position of the switch.

21. The one or more non-transitory machine-readable hardware storage devices of claim 18, wherein the interlocking system is affixed to a portion of the switch.

22. The one or more non-transitory machine-readable hardware storage devices of claim 18, wherein the interlocking system promotes interlocking functionality at the switch.

23. An interlocking system of a railroad, with the interlocking system being located at a turnout in the railroad, and with the interlocking system comprising:

a transceiver for receiving a request message from a train, with the request message being wirelessly received over a global system for mobile communications railway (GSM-R) network, and with the request message including a request to traverse the turnout;

an electronic subsystem for switching the turnout between (i) a first position in which the turnout is in a free state and is available for traversal, and (ii) a second position in which the turnout is in an occupied state and is being traversed by a railway vehicle; and a microcontroller that is configured to autonomously (i) communicate with the electronic subsystem and with the transceiver, (ii) compare a current location of the train relative to the turnout to an expected location of the railway vehicle train relative to the turnout as indicated by a predefined schedule for the turnout, (iii) instruct the turnout to switch from the first position to the second position, following a determination, based on comparison of the current location to the expected location, that the train has priority over other trains for traversing the turnout and receipt of the request message, (iv) autonomously update the predefined schedule, (v) instruct the turnout to switch from the second position to the first position, following receipt of a cleared message from the train, with the cleared message specifying that the train has crossed over the turnout and (vi) cause the transceiver to distribute the update of the predefined schedule to one or more remote devices of the interlocking system;

wherein the transceiver is configured to perform operations comprising:

transmitting, to the train, a request acknowledgement message that specifies the turnout is switched to the second position in which the turnout is in the occupied state;

receiving, from the train, the cleared message that specifies that the train has crossed over the turnout; and transmitting, to the train, a cleared acknowledgement message that specifies that the turnout is switched to the first position in which the turnout is in the free state;

wherein the interlocking system promotes an interlocking functionality independent of operations performed by a control center.

* * * * *